US006835217B1

(12) United States Patent
DeRosa et al.

(10) Patent No.: US 6,835,217 B1
(45) **Date of Patent: *Dec. 28, 2004**

(54) FUEL COMPOSITION CONTAINING FRICTION MODIFIER

(75) Inventors: Thomas F. DeRosa, Southbury, CT (US); Frank J. DeBlase, Hopewll Junction, NY (US); Benjamin J. Kaufman, Hopewell Junction, NY (US); Michael G. Rawdon, Poughkeepsie, NY (US); James R. Ketcham, Salt Point, NY (US); Bryce Alexander Wyman, Poughkeepsie, NY (US)

(73) Assignee: Texaco, Inc., San Ramon, CA (US)

( * ) Notice: Subject to any disclaimer, the term of this patent is extended or adjusted under 35 U.S.C. 154(b) by 382 days.

This patent is subject to a terminal disclaimer.

(21) Appl. No.: 09/666,374

(22) Filed: Sep. 20, 2000

(51) Int. Cl.[7] ..... C10L 1/18; C10L 1/22

(52) U.S. Cl. ..... 44/418; 44/447; 44/451; 44/452

(58) Field of Search ..... 44/385, 447, 451, 44/452, 418

(56) References Cited

U.S. PATENT DOCUMENTS

| | | | | |
|---|---|---|---|---|
| 2,252,889 A | | 8/1941 | Haseltine | |
| 3,273,981 A | | 9/1966 | Furey | |
| 3,368,972 A | | 2/1968 | Otto et al. | |
| 3,413,347 A | | 11/1968 | Worrel et al. | |
| 3,442,808 A | | 5/1969 | Traise et al. | |
| 3,539,633 A | | 11/1970 | Piasek et al. | |
| 3,725,277 A | | 4/1973 | Worrel | |
| 4,185,594 A | | 1/1980 | Perilstein | |
| 4,204,481 A | | 5/1980 | Malec | |
| 4,208,190 A | | 6/1980 | Malec | |
| 4,208,293 A | | 6/1980 | Zaweski | |
| 4,231,759 A | | 11/1980 | Udelhofen et al. | |
| 4,396,517 A | | 8/1983 | Gemmill, Jr. et al. | |
| 4,427,562 A | | 1/1984 | Horodysky et al. | |
| 4,428,182 A | | 1/1984 | Allen et al. | |
| 4,439,336 A | | 3/1984 | Zaweski | |
| 4,617,026 A | | 10/1986 | Shaub et al. | |
| 4,717,492 A | | 1/1988 | Chibnik | |
| 4,729,769 A | | 3/1988 | Schlicht et al. | |
| 4,787,996 A | | 11/1988 | Horodysky et al. | |
| 4,822,507 A | | 4/1989 | Kanamori et al. | |
| 5,089,028 A | | 2/1992 | Abramo et al. | |
| 5,112,364 A | | 5/1992 | Rath et al. | |
| 5,194,068 A | | 3/1993 | Mohr et al. | |
| 5,282,990 A | | 2/1994 | Yoneto et al. | |
| 5,306,313 A | | 4/1994 | Emert et al. | |
| 5,514,190 A | | 5/1996 | Cunningham et al. | |
| 5,522,906 A | | 6/1996 | Hashimoto et al. | |
| 5,551,957 A | | 9/1996 | Cunningham et al. | |
| 5,578,090 A | | 11/1996 | Bradin | |
| 5,634,951 A | | 6/1997 | Colucci et al. | |
| 5,679,116 A | | 10/1997 | Cunningham et al. | |
| 5,697,988 A | | 12/1997 | Malfer et al. | |
| 5,725,612 A | | 3/1998 | Malfer et al. | |
| 5,752,989 A | | 5/1998 | Henly et al. | |
| 5,855,628 A | | 1/1999 | Hashimoto et al. | |
| 5,968,211 A | * | 10/1999 | Schilowitz | 44/402 |
| 6,001,141 A | | 12/1999 | Quigley | |
| 6,010,545 A | | 1/2000 | Davies et al. | |
| 6,039,772 A | * | 3/2000 | Orr | 44/447 |
| 6,074,445 A | * | 6/2000 | Ahmed | 44/385 |
| 6,183,524 B1 | * | 2/2001 | Ahmed | 44/385 |

FOREIGN PATENT DOCUMENTS

| | | |
|---|---|---|
| CA | 2046004 | 12/1991 |
| CA | 2089833 | 2/1993 |
| CA | 2190243 | 11/1996 |
| EP | 0227218 | 7/1987 |
| EP | 0608149 | 7/1994 |
| EP | 0635558 | 1/1995 |
| EP | 0647700 | 4/1995 |
| EP | 0680506 | 11/1995 |
| EP | 0773279 | 5/1997 |
| EP | 0798364 | 10/1997 |
| EP | 0839174 | 5/1998 |
| GB | 2307246 | 5/1997 |
| GB | 2307247 | 5/1997 |
| WO | WO 9900467 | 1/1999 |

OTHER PUBLICATIONS

Office of Research and Development, U.S. Environmental Protection Agency, "Health Risk Perspectives on Fuel Oxygenates", Report No. EPA 600/R–94/217, Dec., 1994.

* cited by examiner

*Primary Examiner*—Cephia D. Toomer
(74) *Attorney, Agent, or Firm*—Michael E. Carmen

(57) ABSTRACT

A fuel composition comprising (a) a major amount of an internal combustion engine hydrocarbon fuel containing at least one alcohol, it being provided that MTBE is substantially absent from the fuel and (b) a friction modifying amount of a reaction product of at least one natural or synthetic oil and at least one alkanolamine is provided. Also provided is a method for operating an engine employing the fuel composition therefor.

27 Claims, No Drawings

FUEL COMPOSITION CONTAINING FRICTION MODIFIER

BACKGROUND OF THE INVENTION

This disclosure relates generally to a fuel composition including at least a major amount of an internal combustion engine hydrocarbon fuel, e.g., gasoline, containing at least one alcohol wherein methyl tertiary-butyl ether is substantially absent from the hydrocarbon fuel and a minor amount of a friction modifier and to a method for operating an internal combustion engine employing the fuel composition as the fuel therefor.

The petroleum industry has long recognized a need for greater fuel economy and efficiency in the operation of hydrocarbon fuel powered internal combustion engines, e.g., spark-ignition engines. In many instances, high compression ratios are desired in order to provide for superior engine performance under various driving conditions. The petroleum industry also recognizes that exhaust emissions from spark-ignition powered engines play a significant role in air pollution.

In an effort to lower toxic exhaust emissions, methyl tertiary-butyl ether ('MTBE') has been added to hydrocarbon fuels for use in spark-ignition engines. Hydrocarbon fuels additized with MTBE are referred to as 'oxygenated fuels'. Exhaust emissions from oxygenated fuels generally contain lower levels of, for example, carbon monoxide, hydrocarbon and nitric oxide.

There has been recent concerns over the toxicity of MTBE and the potential health effects therefrom. See, e.g., Office of Research and Development, U.S. Environmental Protection Agency, "Health Risk Perspectives on Fuel Oxygenates", Report No. EPA 600/R-94/217, December, 1994. For example, problems associated with MTBE-containing fuels include environmental concerns relating to the toxicity of the MTBE-containing fuels and acute symptoms such as headaches and nausea from individuals breathing the fuel's fumes. Thus, it would be desirable to replace MTBE in hydrocarbon fuels thereby eliminating the environmental concerns as well as the potential health effects caused by the use of MTBE-containing fuels.

Ethyl alcohol has been suggested as a replacement for MTBE. Oxygenated fuels derived from ethyl alcohol are significantly less toxic than their MTBE counterpart. Ethyl alcohol-additized fuels, however, demonstratably have reduced fuel economy when used in spark ignition engines.

One approach to achieving enhanced fuel economy while also reducing the wear of engine components is by improving the efficiency of the internal combustion engine in which the fuel is used. Improvement in the engine's efficiency can be achieved through a number of methods, e.g., (1) improving control over fuel/air ratio; (2) decreasing the crankcase oil viscosity; and, (3) reducing the internal friction of the engine in certain specific areas due to wear. In method (3), for example, inside an engine, about 18 percent of the fuel's heat value, i.e., the amount of heat released in the combustion of the fuel and therefore able to perform work, is lost by internal friction routes in engine components, e.g., bearings, valve train, pistons, rings, water and oil pumps, etc. Only about 25 percent of the fuel's heat value is converted to useful work at the crankshaft. Friction occurring at the piston rings and parts of the valve train account for over 50 percent of the heat value loss. A lubricity improving fuel additive, e.g., a friction modifier, capable of reducing friction at these engine components by ⅓ preserves an additional 3% of the fuel's heat value for useful work at the crankshaft. Therefore, there has been a continual search for friction modifiers which improve the delivery of friction modifier to strategic areas of the engine thereby improving the fuel economy of engines.

For example, U.S. Pat. Nos. 2,252,889, 4,185,594, 4,208,190, 4,204,481 and 4,428,182 disclose anti-wear additives for fuels adapted for use in diesel engines consisting of fatty acid esters, unsaturated dimerized fatty acids, primary aliphatic amines, fatty acid amides of diethanolanine and long-chain aliphatic monocarboxylic acids.

U.S. Pat. No. 4,427,562 discloses a friction reducing additive for lubricants and fuels formed by the reaction of primary alkoxyalkylamines with carboxylic acids or alternatively by the ammonolysis of the appropriate formate ester.

U.S. Pat. No. 4,729,769 discloses a detergent additive for gasoline, which contains the reaction product of a $C_6$–$C_{20}$ fatty acid ester such as coconut oil and a mono- or di-hydroxy hydrocarbyl amine such as diethanolarine or dimethylaminopropylarnine.

SUMMARY OF THE INVENTION

In accordance with the present invention, a fuel composition is provided which comprises:

(a) a major amount of an internal combustion engine hydrocarbon fuel containing at least one alcohol, it being provided that methyl tertiary-butyl ether is substantially absent from the fuel; and, (b) a friction modifying amount of a reaction product of at least one natural or synthetic oil and at least one alkanolamine.

Further in accordance with the present invention, a method of operating an internal combustion engine is provided which comprises operating the engine employing as a fuel therefor a fuel composition which comprises:

(a) a major amount of an internal combustion engine hydrocarbon fuel containing at least one alcohol, it being provided that methyl tertiary-butyl ether is substantially absent from the fuel; and, (b) a friction modifying amount of a reaction product of at least one natural or synthetic oil and at least one alkanolamine.

The term "hydrocarbon fuel" as utilized herein shall be understood as referring to those hydrocarbon fuels such as, for example, gasoline or diesel.

The term "gasoline" as utilized herein shall be understood as referring to a fuel for spark-ignition internal combustion engines consisting essentially of volatile flammable liquid hydrocarbons derived from crude petroleum by processes such as distillation reforming, polymerization, catalytic cracking, and alkylation. The term "diesel" as utilized herein shall be understood as referring to that fraction of crude oil that distills after kerosene and is useful for internal combustion in compression-ignition engines.

The term "natural oil" utilized herein refers to those naturally occurring oils that are derived from animal or plant sources. Such oils are mixed $C_6$–$C_{22}$ fatty acid esters, i.e., glycerol fatty acid esters, and include specifically coconut oil, babassu oil, palm kernel oil, palm oil, olive oil, castor oil, rape oil, beef tallow oil, whale oil, sunflower, cottonseed oil, linseed oil, tung oil, tallow oil, lard oil, peanut oil, soya oil, etc. It will be understood that such oils will predominately comprise triglycerides with small amounts, e.g. up to about 10 weight percent, of mono- and diglycerides.

The term "synthetic oil" utilized herein refers to products produced by reacting carboxylic acids with glycerol, e.g., glycerol triacetate, and the like. It will be understood that such synthetic oils can contain between about 0.1 wt % to about 20 wt. % mono- and di-glycerides, and mixtures thereof.

The hydrocarbon fuels containing at least one alcohol and wherein MTBE is substantially absent therefrom are less toxic than those fuels containing MTBE. Additionally, by utilizing a friction modifier in the fuel composition of this invention, greater fuel economy and efficiency in the operation of a hydrocarbon fuel powered internal combustion engine employing the foregoing fuel composition can be achieved.

DESCRIPTION OF THE PREFERRED EMBODIMENTS

By employing the aforestated reaction product in a friction modifying amount in the fuel composition of this invention, greater fuel economy and efficiency in the operation of internal combustion engines can be achieved than a fuel containing only an alcohol with MTBE being substantially absent therefrom. Additionally, the fuel composition of this invention exhibits substantially less toxicity than those fuels containing MTBE. In general, the fuel composition of this invention will include at least (a) a major amount of an internal combustion engine hydarbon fuel containing at least one alcohol, it being provided that MTBE is substantially absent from the hydrocarbon fuel and (b) a friction modifying amount of a reaction product of at least one natural or synthetic oil and at least one alkanolamine.

Suitable base fuels for use in formulating the fuel composition of this invention include any hydrocarbon fuel such as, for example, gasoline, diesel, kerosene, jet fuels, etc. When the fuel is gasoline, it can be derived from straight-chain naphtha, polymer gasoline, natural gasoline, catalytically cracked or thermally cracked hydrocarbons, catalytically reformed stocks, and the like. It will be understood by one skilled in the art that gasoline fuels typically boil in the range of from about 80° F. to about 450° F. and can consist of straight chain or branched chain paraffins, cycloparaffins, olefins, aromatic hydrocarbons and any mixture of these.

When the fuel is diesel, such fuels generally boil above about 212° F. The diesel fuel can comprise atmospheric distillate or vacuum distillate, or a blend in any proportion of straight run and thermally and/or catalytically cracked distillates. Preferred diesel fuels have a cetane number of at least 40, preferably above 45 and more preferably above 50. The diesel fuel can have such cetane numbers prior to the addition of any cetane improver with the cetane number of the fuel being increased by the addition of the cetane improver.

The base fuel will also contain at least one alcohol in order to reduce exhaust emissions from the engine. Suitable alcohols for use herein include methanol, ethanol, propanol, isopropanol, butanol, t-butanol, pentanol, hexanol, heptanol, octanol, nonanol, decanol, undecanol, dodecanol, tridecanol, tetracanol, pentadecanol, phenol and the like and mixtures thereof. A preferred alcohol for use herein is ethanol. Generally, the alcohol is present in the base fuel in an amount below about 25 percent by volume, preferably in an amount ranging from about 0.5 to about 20 percent by volume and more preferably in an amount that provides an oxygen content in the overall fuel in the range of about 1 to about 15 percent by volume.

Generally, a friction modifying amount of a reaction product of at least one natural or synthetic oil with at least one alkanolamine is advantageously employed to form the fuel composition of this invention.

Natural oils such as mixed $C_6$–$C_{22}$ fatty acid esters, i.e., glycerol fatty acid esters or triglycerides derived from natural sources, for use herein include, but are not limited to, beef tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil, soya oil and the like with coconut oil being the preferred natural oil.

The natural oil(s) which can be employed in the fuel additive composition of this invention will typically contain $C_6$–$C_{22}$ fatty acid esters, i.e., several fatty acid moieties, the number and type varying with the source of the oil. Fatty acids are a class of compounds containing a long hydrocarbon chain and a terminal carboxylate group and are characterized as unsaturated or saturated depending upon whether a double bond is present in the hydrocarbon chain. Therefore, an unsaturated fatty acid has at least one double bond in its hydrocarbon chain whereas a saturated fatty acid has no double bonds in its fatty acid chain. Preferably, the acid is saturated. Examples of unsaturated fatty acids include, myristoleic acid, paimitoleic acid, oleic acid, linolenic acid, and the like. Examples of saturated fatty acids include caproic acid, caprylic acid, capric acid, lauric acid, myristic acid, palmitic acid, stearic acid, arachidic acid, behenic acid, lignoceric acid, and the like.

The acid moiety may be supplied in a fully esterfied compound or one which is less than fully esterfied, e.g., glyceryl tri-stearate, or glyceryl di-laurate and glyceryl mono-oleate, respectively. Esters of polyols including diols and polyalkylene glycols can be employed such as esters of mannitol, sorbitol, pentaerytherol, polyoxyethylene polyol and the like.

Synthetic oils for use herein include alkoxylated alkylphenols, alkoxylated alcohols, polyalkeneoxide based alcohols and diols, esters thereof employing carboxylic acids, ethers of the foregoing compounds, esters of aliphatic acids, e.g., polybasic acids, and esters of aliphatic alcohols, e.g., polyhydric alcohols, and the like.

The alkanolamine which is reacted with the natural or synthetic oil(s) to form a reaction product can be, for example, a primary or secondary amine which possesses at least one hydroxy group. The expression "alknolamine" is used in its broadest sense to include compounds containing at least one primary or secondary amine and at least one hydroxy group such as, for example, monoalkanolamines, dialkanolamines, and so forth. It is believed that almost any alkanolamine can be used, although preferred alkanolamines are lower alkanolamines generally having from about two to about six carbon atoms. The alkanolamine can possess an O or N functionality in addition to the one amino group (that group being a primary or secondary amino group) and the at least one hydroxy group. The alkanolamine preferably possesses the general formula $HN(R'OH)_{2-x}H_x$ wherein R' is a lower hydrocarbyl having from about two to about six carbon atoms and x is 0 or 1. Suitable alkanolamines for use herein include monoethanolamine, diethanolamine, propanolamine, isopropanolamine, dipropanolamine, di-isopropanolamine, butanolamines, aminoethylaminoethanols, e.g., 2-(2-aminoethylamino)ethanol, and the like. It is also contemplated that mixtures of two or more alkanolamines can be employed. Diethanolamine is highly preferred for use in accordance with the practice of the present invention.

In general, the reaction can be conducted by heating the mixture of natural or synthetic oil(s) and alkanolamine in the desired ratio to produce the desired reaction product. The reaction can typically be conducted by maintaining the reactants at a temperature of from about 100° C.–200° C. and preferably from about 120° C.–150° C. for a time period ranging from about 1–10 hours and preferably from about 24 hours. The weight ratio of natural or synthetic oil(s) to alkanolamine will ordinarily range from about 0.2 to about 3 and preferably from about 0.7 to about 2.

If desired, the reaction can be carried out in solvent, preferably one which is compatible with the ultimate composition in which the product is to be used. Useful solvents include, but are not limited to, Aromatic-100, Aromatic-150, Shellsolv AB, Abet, toluene, xylene, and the like and mixtures thereof.

It will be readily understood and appreciated by those skilled in the art that the foregoing reaction product constitutes a complex mixture of compounds including fatty acid amides, fatty acid esters, fatty acid ester-amides, unreacted starting reactants, free fatty acids, glycerol, and partial fatty acid esters of glycerol (i.e., mono- and di-glycerides). Fatty acid amides are formed when the amine group of the alkanolamine reacts with the carboxyl group of a fatty acid. Fatty acid esters are formed when one or more hydroxyl groups of the alkanolamine reacts with the carboxyl group of a fatty acid. Fatty acid ester-amides are formed when both the amine and hydroxyl group of the alkanol amine reacts with the carboxyl groups of fatty acids. Typically, the reaction product will contain from about 5 to about 65 mole % of the fatty acid amide as well as about 5 to about 65 mole % of the fatty acid ester-amide, about 3 to about 30 mole % of the fatty acid ester, about 0.1 to about 50 mole % of the partial fatty acid ester, about 0.1 to about 30 mole % of the by-product typified by glycerol, about 0.1 to about 30 mole % of free fatty acids, about 0.1 to about 30 mole % of the charge alkanolamine, about 0.1 to about 30 mole % of the charge glycerides, etc. The reaction product mixture need not be separated to isolate one or more specific components. Indeed, the reaction product mixture can be preferably employed as is in the fuel composition of this invention.

Generally, the friction modifying amount of the foregoing reaction product employed in the fuel composition of this invention will range from about 0.1 to about 1000 pounds per thousand barrels (PTB), preferably from about 10 to about 500 PTh and more preferably from about 25 to about 150 PTB.

If desired, the base fuel and reaction product of natural or synthetic oil(s) and alkanolamine can be used in combination with a carrier. Such carriers can be of various types such as liquid carriers (also referred to as a solvent, diluent or induction aid) or solids, e.g., waxes, with liquid carriers being preferred. Representatives of the liquid carriers that can be used herein are those disclosed in U.S. Pat. Nos. 5,551,957, 5,634,951 and 5,679,116, the contents of which are incorporated by reference herein. Examples of suitable liquid carriers include such materials as liquid poly-α-olefin oligomers such as, for example, hydrotreated and unhydrotreated poly-olefin oligomers, i.e., hydrogenated or unhydrogenated products, primarily trimers, tetramers and pentamers of α-olefin monomers which monomers contain from about 6 to about 12 carbon atoms; liquid polyalkene hydrocarbons, e.g., polypropene, polybutene, polyisobutene, or the like; liquid hydrotreated polyalkene hydrocarbons, e.g., hydrotreated polypropene, hydrotreated polybutene, hydrotreated polyisobutene, or the like; mineral oils; liquid polyoxyalkylene compounds; liquid alcohols or polyols; liquid esters, and similar liquid carriers or solvents. It is also contemplated that mixtures of two or more such carriers or solvents can be employed herein.

Preferred liquid carriers for use herein are polyethers such as substituted polyethers, cyclic polyethers (i.e., crown ethers), aromatic polyethers, polyether alcohols, and the like with polyether alcohols being most preferred. In general, the polyether alcohol(s) will possess the general formula

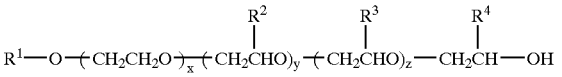

wherein x is an integer from 0 to about 5, y is an integer from 1 to about 49 preferably from about 5 to about 40 and more preferably from about 5 to about 10, z is an integer from 1 to about 49, preferably from about 5 to about 40 and more preferably from about 5 to about 10 and the sum of x+y+z is equal to 3 to about 50; $R^1$ is an alkyl, an alicyclic or an alkylalicyclic radical having from about 4 to about 30 carbon atoms or an alkylaryl where the alkyl group is from about 4 to about 30 carbon atoms, including, by way of illustration, unsubstituted straight or branched aliphatic, cycloaliphatic and aromatic groups and cycloaliphatic and aromatic groups substituted with one or more straight or branched aliphatic, cycloaliphatic and/or aromatic groups. Thus, for example, $R^1$ can be represented by the general formula

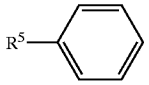

wherein $R^5$ is a hydrocarbyl group of from about 4 to about 30 carbon atoms including, by way of example, a monovalent aliphatic radical having from about 6 to about 24 carbon atoms, preferably from about 8 to about 20 carbon atoms and more preferably from about 9 to about 18 carbon atoms. $R^2$ and $R^3$ each is different and is an alkyl group of from 1 to 4 carbon atoms and each oxyalkylene radical can be any combination of repeating oxyalkylene units to form random or block copolymers with the random copolymers being preferred; and $R^4$ is the same as $R^2$ or $R^3$. The preferred polyether alcohol for use herein as the liquid carrier is a mixture of 2(4-n-nonyl(poly(propylene oxide-co-butylene oxide)phenylether)-1-n-propyl alcohol and 2-(4-n-nonyl (polytpropylene oxide-co-butylene oxide)phenylether)-1-n-butyl alcohol.

It is also advantageous to employ at least one fuel detergent in the fuel composition of this invention. The fuel detergent for use herein can be any commercially available fuel detergent known to one skilled in the art employed to reduce the incidence of deposit formation in the combustion chamber and intake system of an engine. Suitable fuel detergents include any polyether amine and/or one or more of the type based on a polyolefin, e.g., polyethylene, polypropylene, polybutylene, including isomers thereof, and copolymers of at least two of the foregoing; and polyolefin-based detergents, e.g., imides such as succinimide, amines and the like where the latter may be made by chlorinating selected olefins, and reacting the thus-chlorinated olefins with polyamines, e.g., ethylenediamine, tetraethylenepentaamine, etc. A suitable selected olefin is polyisobutene having a molecular weight in the range of from 450 to 1500, and more preferably 900 to 1400. Another suitable detergent may be based on a polyisobutene, preferably of molecular weight in the range of from 450 to 1500, more preferably 900 to 1400, which has been reacted with maleic acid and the resulting acid-functionalised polyolefin thereafter reacted with a polyanine such as tetraethylenepentamine. Processes not involving chlorine are also known. For example, the OXO process used by BASF in preparing a polyolefin-amine which are commercially available as Puradd FD-100 and the like.

Another suitable detergent for use herein is a Mannich base detergent. The Mannich base detergent can be any commercially available Mannich base known to one skilled in the art. Representative of the Mannich bases are those disclosed in U.S. Pat. Nos. 3,368,972; 3,413,347; 3,539,633; 3,752,277; 4,231,759; and, 5,634,951 the contents of which are incorporated by reference herein.

In general, Mannich bases can be obtained from, for example, the condensation reaction product of an alkylphenol, aldehyde and amine or polyamine. Methods for preparing these Mannich base compounds are known in the art and do not constitute a part of the present invention. The alkylphenol can be mono or dialkyl substituted with the alkyl group being substituted in the para position being preferred. The alkyl group can contain from about 50 to about 20,000 carbon atoms, and preferably from about 200 to about 300 carbon atoms. Suitable alkylphenols include polypropylphenol polybutylphenol, polyisobutylphenol, polypentylphenol, polybutyl-co-polypropylphenols and the like. Other similar long-chain alkylphenols may be used, but are less preferred.

The aldehyde employed in the Mannich base can be free aldehyde, aqueous solution of aldehyde or a polymerized form of an aldehyde which can provide monomeric aldehyde under the reaction conditions. Representative aldehydes for use in the preparation of the Mannich base products include aliphatic aldehydes such as formaldehyde, acetaldehyde, propionaldehyde, butaaaldehyde, valeraldehyde, caproaldehyde, heptaldehyde, stearaldehyde and the like; aromatic aldehydes such as benzaldehyde, salicylaldehyde and the like, heterocyclic aldehydes such as furfural, thiophene aldehyde and the like. Other aldelhydes include formaldehyde-producing reagents such as paraformaldehyde, aqueous formaldehyde solutions e.g., formalin and the like, with formaldehyde and formalin being preferred.

The amine can be any one of a wide range of amines having a reactive nitrogen group, and generally contains less than about 100 carbon atoms. Suitable amines include polyamines of the general formula:

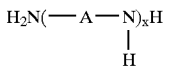

wherein A is a divalent alkylene radical of 2 to about 6 carbon atoms and x is an integer of 1 to 10 and preferably of 2 to 6. Useful polyamines include poly-ethyleneamines, propylene-polyamines, ethylenediamine, diethylenetriamine, triethylenetetramine, tetraethylenepentamine, pentaethylene hexamine, hexaethyleneheptamine, propylenediamine, dipropylenetriamine, tripropylenetetramine, tetrapropylenepentamine, pentapropylenehexamine, hexapropyleneheptamine and the like with ethylenepolyamines such as tetraethylenepentamine being preferred. The polyamines can be prepared by methods well-known in the art.

When a polyamine which has more than two amino groups is a reactant, and more than two moles each of alkylphenol and formaldehyde per mole of polyamine are used, the internal amino groups may also have alkyl-and hydroxy-substituted benzyl substituents. Depending upon the particular polyamine used, the particular ratio of alkylphenol and formaldehyde to polyamine employed, the reaction produced may have none, some, or all of the internal amine groups of the polyamine substituted with an alkyl-and hydroxy-substituted benzyl group.

Any amine used may have additional substitutions so long as it does not destroy the fuel solubility of the final Mannich compound, and does not interfere with the Mannich condensation. For example, hydroxyl substituted amines can be employed herein.

The fuel composition of this invention can be prepared by mixing the base fuel (a) containing at least one alcohol therein with the reaction product (b) and, optionally, a carrier and/or fuel detergent, either sequentially or in any suitable order. For example, the base fuel can be combined with the reaction product and then this mixture is combined with the carrier and/or fuel detergent or a mixture of reaction product and carrier and/or fuel detergent can be combined with the base fuel. This mixing can take place before the addition of the reaction product to the fuel or during the mixing of the fuel containing the reaction product of this invention. The order of addition and/or combinations of the various components of this invention is therefore not critical and all such orders of addition and/or combination of the components are envisioned as being within the scope of the invention herein.

In the fuel composition of this invention, other fuel additives can be employed to enhance the performance of the fuel, including, for example, antioxidants, corrosion inhibitors, dehazers, demulsifiers, metal deactivators, anti-foaming agents, combustion improvers such as cetane improvers, co-solvents, package compatibilisers, metallic-based additives such as metallic combustion improvers, anti-knock agents, anti-icing additives and mixtures thereof.

A fuel composition containing the friction modifying amount of the aforestated reaction product of the invention is suitable for the operation of an internal combustion engine. When the base fuel is gasoline, the fuel composition will be suitable for use in, e.g., spark-ignition engines typically operated on such fuels. When the base fuel is diesel, the fuel composition will be suitable for use in, e.g., compression-ignition engines typically operated on such fuels. It is to be understood that the fuel compositions of this invention can be used to operate a variety of engines and in any other application requiring a fuel, e.g., jet engines, furnaces, etc.

The following examples serve to illustrate the method of making the present fuel composition.

EXPERIMENTAL SECTION

I. Preparation of Friction Modifier

Example 1

1.3 Kg coconut oil (approximate molecular weight 657 AMU) was heated to about 60° C. and 0.38 Kg diethanolamine was added with stirring. The mixture was then heated under nitrogen to 120° C. and held at 120° C. for 4 hours and polish-filtered at 100°–120° C. The product was quantitatively isolated as a yellow semi-solid containing a nitrogen content of 2.9% and base number TBN target of 9.

II. Preparation of Fuel Blends

Gasoline Blend 1

Gasoline fuel containing 0 percent by volume MTBE and 10 percent by volume ethanol was additized with 52 PTh of the friction modifier of Example 1.

Gasoline Blend 2

Gasoline fuel containing 0 percent by volume MTBE and 10 percent by volume ethanol was additized with 100 PTB of the friction modifier of Example 1.

Gasoline Blend 3

Gasoline fuel containing 0 percent by volume MTBE and 13 percent by volume ethanol was additized with 52 PTB of the friction modifier of Example 1.

Comparative Gasoline Blend A

A gasoline fuel containing 0 percent by volume MTBE and ethyl alcohol was additized with 52 PTB of the friction modifier of Example 1.

Comparative Gasoline Blend B

A gasoline fuel containing 0 percent by volume MTBE and 10 percent by volume ethanol.

Comparative Gasoline Blend C

A gasoline fuel containing 0 percent by volume MTBE and 13 percent by volume ethanol.

III. Test Results

Lubricity testing of the Gasoline Blends 1–3 and Comparative Gasoline Blends A and B were performed at 25° C. using the High Frequency Reciprocating Rig (HFRR) method described in ASTM method D 6079-97. Wear Scar Diameter (WSD) of Friction Modifiers is calculated using Equation (1):

$$WSD=(M+N)/2 \qquad \text{Eq.(1)}$$

WSD=wear scar diameter, mm
M=Major Axis, mm
N=Minor Axis, mm

The HFRR test results are summarized below in Table 1.

TABLE 1

| Sample | Ethanol Amount (vol %) | Co-Additive | Co-additive Amount (PTB) | HFRR (mm) |
|---|---|---|---|---|
| Comp. Blend A | — | Friction Modifier | 52 | 455 |
| Comp. Blend B | 10 | None | — | 712 |
| Blend 1 | 10 | Friction Modifier | 52 | 642 |
| Blend 2 | 10 | Friction Modifier | 100 | 512 |
| Comp. Blend C | 13 | None | — | 846 |
| Blend 3 | 13 | Friction Modifier | 52 | 468 |

As these data illustrate, by employing a friction modifier together with gasoline containing 10 percent by volume ethanol in Blend 1 (which is within the scope of this invention) as compared to gasoline containing 10 percent by volume ethanol with no friction modifier in Comparative Blend B (which is outside the scope of this invention) significantly greater fuel economy was achieved, i.e., an HFRR of 642 for Blend 1 as compared to 712 for Comparative Blend B. Additionally, by employing the friction modifier together with gasoline containing 13 percent by volume ethanol in Blend 3 (which is within the scope of this invention) as compared to gasoline containing 13 percent by volume ethanol with no friction modifier in Comparative Blend C (which is outside the scope of this invention) significantly greater fuel economy was still achieved, i.e., an HFRR of 468 for Blend 3 compared to 846 for Comparative Blend C. It is both unexpected but readily apparent that incorporating the reaction product mixture of coconut oil and diethanolamine into a hydrocarbon fuel containing at least one alcohol with MTBE being substantially absent therefrom significantly improves the fuel economy and efficiency of the internal combustion engine.

What is claimed is:

1. A fuel composition comprising:

(a) a major amount of an internal combustion engine hydrocarbon fuel containing at least one alcohol, it being provided that methyl tertiary-butyl ether is substantially absent from the fuel; and, (b) a friction modifying amount of a reaction product of at least one natural or synthetic oil and at least one alkanolamine; and, (c) at least one fuel detergent.

2. The fuel composition of claim 1 wherein the hydrocarbon fuel is selected from the group consisting of gasoline, diesel, kerosene and jet fuels.

3. The fuel composition of claim 1 wherein the alcohol is selected from the group consisting of methanol, ethanol, propanol, isopropanol, butanol, t-butanol, pentanol, hexanol, heptanol, octanol, nonanol, decanol, undecanol, dodecanol, trideconol, tetradecanol, pentadecanol, phenol and mixtures thereof.

4. The fuel composition of claim 1 wherein the alcohol is present in the hydrocarbon fuel in an amount of less than about 25 percent by volume.

5. The fuel composition of claim 1 wherein the reaction product is a natural oil and an alkanolamine, the natural oil being a glycerol $C_6$–$C_{22}$ fatty acid ester.

6. The fuel composition of claim 5 wherein the natural oil is selected from the group consisting of beef tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil and soya oil.

7. The fuel composition of claim 1 wherein the alkanolamine is selected from the group consisting of monoethanolamine, diethanolamine, propanolamine, isopropanolamine, dipropanolamine, di-isopropanolamine, butanolamines, aminoethylaminoethanol and mixtures thereof.

8. The fuel composition of claim 1 wherein the weight ratio of natural or synthetic oil to alkanolamine is from about 0.2 to about 3.

9. The fuel composition of claim 1 wherein the friction modifying amount of the reaction product of component (b) present in the fuel composition is from about 0.1 to about 1000 PTB.

10. The fuel composition of claim 1 further comprising a carrier.

11. The fuel composition of claim 10 wherein the carrier is a liquid carrier selected from the group consisting of substituted polyethers, cyclic polyethers aromatic polyethers and polyether alcohols.

12. The fuel composition of claim 11 wherein the polyether alcohol possesses the general formula

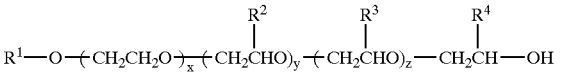

wherein x is an integer from 0 to about 5, y is an integer from 1 to about 49, z is an integer from 1 to about 49 and the sum of x+y+z is equal to 3 to about 50; $R^1$ is an alkyl, an alicyclic or an alkylalicyclic radical having from about 4 to about 30 carbon atoms or an alkylaryl where the alkyl group is from about 4 to about 30 carbon atoms; $R^2$ and $R^3$ each is different and is an alkyl group of from 1 to 4 carbon atoms and each oxyalkylene radical can be any combination of repeating oxyalkylene units to form random or block copolymers; and $R^4$ is the same as $R^2$ and $R^3$.

13. The fuel composition of claim 12 wherein the polyether alcohol is a mixture of 2-(4-n-nonyl(poly(propylene oxide-co-butylene oxide)phenylether)-1-n-propyl alcohol and 2-(4-n-nonyl(poly(propylene oxide-co-butylene oxide) phenylether)-1-n-butyl alcohol.

14. The fuel composition of claim 10 wherein the amount of the carrier present in the fuel composition is from about 10 to about 1000 PTB.

15. The fuel composition of claim 1 wherein the fuel detergent is selected from the group consisting of Mannich base detergents, polyetheramines, polyolefin-amines, polyolefin polyamines, polyolefin-phenolpolyamines, polyolefin succinimides and mixtures thereof.

16. A method of operating an internal combustion engine which comprises operating the engine employing as a fuel therefor a fuel composition which comprises:

(a) a major amount of an internal combustion engine hydrocarbon fuel containing at least one alcohol, it being provided that methyl tertiary-butyl ether is substantially absent from the fuel; and, (b) a friction modifying amount of a reaction product of at least one natural or synthetic oil and an alkanolamine; and, (c) at least one fuel detergent.

17. The method of claim 16 wherein the hydrocarbon fuel is selected from the group consisting of gasoline, diesel, kerosene and jet fuels.

18. The method of claim 16 wherein the alcohol is selected from the group consisting of methanol, ethanol, propanol, isopropanol, butanol, t-butanol, pentanol, hexanol, heptanol, octanol, nonanol, decanol, undecanol, dodecanol, trideconol, tetradecanol, pentadecanol, phenol and mixtures thereof.

19. The method of claim 16 wherein the alcohol is added to the hydrocarbon fuel in an amount of less than about 25 percent by volume.

20. The method of claim 16 wherein the reaction product is a natural oil and an alkanolamine, the natural oil being a glycerol $C_6$–$C_{22}$ fatty acid ester.

21. The method of claim 20 wherein the natural oil is selected from the group consisting of beef tallow oil, lard oil, palm oil, castor oil, cottonseed oil, corn oil, peanut oil, soybean oil, sunflower oil, olive oil, whale oil, menhaden oil, sardine oil, coconut oil, palm kernel oil, babassu oil, rape oil and soya oil.

22. The method of claim 16 wherein the alkanolamine is selected from the group consisting of monoethanolamine, diethanolamine, propanolamine, isopropanolamine, dipropanolamine, di-isopropanolamine, butanolamines, aminoethylaminoethanol and mixtures thereof.

23. The method of claim 16 wherein the weight ratio of natural or synthetic oil to alkanolamine is from about 0.2 to about 3.

24. The method of claim 16 wherein the fuel composition further comprises a carrier.

25. The method of claim 24 wherein the carrier is a polyether alcohol of the general formula

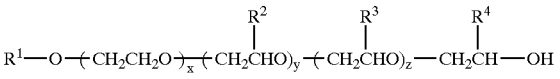

wherein x is an integer from 0 to-about 5, y is an integer from 1 to about 49, z is an integer from 1 to about 49 and the sum of x+y+z is equal to 3 to about 50; $R^1$ is an alkyl, an alicyclic or an alkylalicyclic radical having from about 4 to about 30 carbon atoms or an alkylaryl where the alkyl group is from about 4 to about 30 carbon atoms; $R^2$ and $R^3$ each is different and is an alkyl group of from 1 to 4 carbon atoms and each oxyalkylene radical can be any combination of repeating oxyalkylene units to form random or block copolymers; and $R^4$ is the same as $R^2$ and $R^3$.

26. The method of claim 24 wherein the amount of the carrier present in the fuel composition is from about 10 to about 1000 PTB.

27. The method of claim 16 wherein the fuel detergent is selected from the group consisting of Mannich base detergents, polyetheramines, polyolefin-amines, polyolefin-polyamines, polyolefin-phenol-polyamines, polyolefin succinimides and mixtures thereof.

* * * * *